US007668495B2

(12) United States Patent
Lee et al.

(10) Patent No.: US 7,668,495 B2
(45) Date of Patent: Feb. 23, 2010

(54) APPARATUS AND METHOD OF HEATING IMAGE ON RECORDABLE MATERIAL

(75) Inventors: Dong Woo Lee, Seoul (KR); Tae Gyu Kim, Hwaseog-si (KR); Su Ho Shin, Seongnam-si (KR); Hwan Guem Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 224 days.

(21) Appl. No.: 11/779,468

(22) Filed: Jul. 18, 2007

(65) Prior Publication Data

US 2008/0219724 A1 Sep. 11, 2008

(30) Foreign Application Priority Data

Mar. 6, 2007 (KR) ..... 10-2007-0021861

(51) Int. Cl.
*G03G 15/20* (2006.01)

(52) U.S. Cl. ..... 399/329

(58) Field of Classification Search ..... 399/107, 399/122, 320, 328, 329; 219/216, 619
See application file for complete search history.

(56) References Cited

U.S. PATENT DOCUMENTS

| | | | | |
|---|---|---|---|---|
| 6,498,911 | B2 * | 12/2002 | Hiroki et al. | 399/69 |
| 6,631,253 | B2 * | 10/2003 | Nakafuji et al. | 399/329 |
| 7,330,688 | B2 * | 2/2008 | Watanabe et al. | 399/329 |
| 7,454,161 | B2 * | 11/2008 | Watanabe et al. | 399/329 |

FOREIGN PATENT DOCUMENTS

| | | |
|---|---|---|
| JP | 09-54510 | 2/1997 |
| JP | 2005-134646 | 5/2005 |
| JP | 2006-11247 | 1/2006 |
| JP | 2006-65049 | 3/2006 |
| JP | 2006-65363 | 3/2006 |
| JP | 2006-133471 | 5/2006 |

* cited by examiner

*Primary Examiner*—Hoan H Tran
(74) *Attorney, Agent, or Firm*—Stanzione & Kim LLP

(57) ABSTRACT

An image heating apparatus including: a pressure member; a fixing roller to rotate on the pressure member; a heater to heat an external surface of the fixing roller; and a film to be heated by the heater. While passing through a gap between the pressure member and the fixing roller, the film may form a nip with the pressure member. The image heating apparatus may reduce an initial warm-up time through a film heating operation, and may utilize the fixing roller as a heat reservoir by heating the fixing roller.

7 Claims, 5 Drawing Sheets

APPARATUS AND METHOD OF HEATING IMAGE ON RECORDABLE MATERIAL

CROSS-REFERENCE TO RELATED APPLICATIONS

This application claims priority under 35 U.S.C §119(a) from Korean Patent Application No. 10-2007-0021861, filed on Mar. 6, 2007, in the Korean Intellectual Property Office, the disclosure of which is incorporated herein in its entity by reference.

BACKGROUND OF THE INVENTION

1. Field of the Invention

The present general inventive concept relates to an image heating apparatus, and more particularly, to a method and apparatus to fuse an image, which can reduce a warm-up time and also can improve a fusing quality.

2. Description of the Related Art

An image heating apparatus generally includes a heating roller and a pressure roller. The image heating apparatus may pass a printing paper, formed with an image, through the heating roller and the pressure roller to fuse the image on the printing paper. Accordingly, the image heating apparatus may be used for a copying machine, a printer, a facsimile, and the like. Also, the image heating apparatus may be used to fuse character or image information on a printing paper as an image.

A main task of the image heating apparatus may be to fuse an image identical to an original image on the printing paper. Also, the image heating apparatus may reduce an initial warm-up time and power consumption.

FIG. 1 is a cross-sectional view illustrating an image heating apparatus according to a conventional art.

Referring to FIG. 1, the conventional image heating apparatus includes a pressure roller 10 and a heating roller 12. In this instance, the heating roller 12 includes a heating element such as a lamp or an electric heating coil, and may be heated up to a predetermined temperature and maintained at the temperature by using the heating element. However, since the heating roller 12 is entirely heated by a lamp 14, a comparatively greater warm-up time is required. As an example, when the entire heating roller 12 is utilized, it may take more than 30 seconds to raise the temperature of a nip up to about 160° C.

FIG. 2 is a cross-sectional view illustrating another image heating apparatus according to the conventional art.

Referring to FIG. 2, the image heating apparatus includes a pressure roller 20, a fixing roller 22, a belt 24, and a heating roller 26. In this instance, the fixing roller 22 is provided above the pressure roller 20, and the belt 24 passes through a gap between the pressure roller 20 and the fixing roller 22 via the heating roller 26. The pressure roller 20, the fixing roller 22, and the belt 24 form a nip N to fuse a toner image. A pre-fused toner image may be fused on a printing paper while passing through the nip N.

In the image heating apparatus of FIG. 2, the heating roller 26 may be formed in a comparatively smaller size and thus may be quickly heated. Accordingly, an initial warm-up time may be reduced when compared to heating the comparatively larger pressure roller 12 of the image heating apparatus of FIG. 1. As an example, when an image heating apparatus similar to the image heating apparatus of FIG. 2 utilizes a heater with a capacity of about 1.3 kW, it may take about 20 to 22 seconds to raise the image heating apparatus from room temperature up to about 160° C.

In this instance, heat is indirectly transmitted to the nip N through the belt 24 instead of direct transmission, and thus the initial warm-up time may be slow. Also, while the belt 24 is heated by the heating roller 26 and being moved to the nip N, the temperature of the belt 24 may non-uniformly change due to heat radiation, which may deteriorate a fusing quality.

SUMMARY OF THE INVENTION

The present general inventive concept provides an image heating apparatus which can quickly raise a temperature in a nip and thereby reduce an initial warm-up time.

The present general inventive concept also provides an image heating apparatus which can reduce an initial heating warm-up time and also can maintain a temperature to be uniform in a nip.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image heating apparatus including: a pressure member; a fixing roller to rotate on the pressure member; a heater to heat an external surface of the fixing roller; and a film to be heated by the heater. In this instance, the heating temperature of the nip may be raised to a predetermined level and maintained at the level by using the fixing roller and the film as media. Specifically, the heater may simultaneously heat both the external surface of the fixing roller and the film.

The image heating apparatus may quickly reach a predetermined warm-up temperature by using a significantly rising temperature of the film. Also, the image heating apparatus may uniformly maintain the heating temperature by using the fixing roller, with a comparatively smaller temperature change, as a heat reservoir.

Also, the pressure member may contact with the fixing roller and the film in a pressurized state and thus may form the nip to fuse an image on a recording medium. A roller with a surface formed using a rubber material may be generally utilized for the pressure member. Also, a different element capable of easing a movement of the recording medium may be utilized for the pressure roller.

The heater may directly heat the external surface of the fixing roller and also may heat the film at the same time. In this instance, the heater may include a heating element, such as a halogen lamp, a ceramic heating element, and the like. Also, the heater may transmit heat through a heat conduction while directly contacting with the fixing roller. Also, the heater may be provided adjacent to the external surface of the fixing roller and thereby transmit heat through a heat radiation without contacting with the fixing roller. The conventional heating roller may transmit heat to only either a film or a belt while rotating with the film or the belt. However, the heater may simultaneously transmit heat to both the film and the fixing roller. Accordingly, the image heating apparatus may reduce an initial warm-up time and uniformly maintain a heating temperature during an operation, and thereby provide a uniform fusing quality.

The foregoing and/or other aspects and utilities of the present general inventive concept may also be achieved by providing an image heating apparatus including: a pressure roller; a fixing roller to rotate in engagement with the pressure roller; a heater to comprise a protective cover which is provided adjacent to an external surface of the fixing roller and is open towards the fixing roller, and a heating element which is contained in the protective cover and thereby directly heats the external surface of the heating roller; and a belting film to circulate around the fixing roller, form a nip with the pressure roller, and pass through a gap between the pressure roller and the fixing roller while contacting with an external surface of the protective cover.

The pressure roller and the fixing roller may correspond to each other and thereby rotate. Also, the belting film may circulate around the fixing roller and form the nip with the pressure roller. In this instance, the heater may include the heating element which is provided adjacent to the fixing roller, and the protective cover which contains the heating element. The protective cover has one side open towards the fixing roller so that the heating element may directly heat the external surface of the fixing roller. Also, since the belting film passes through the gap between the pressure roller and the fixing roller while contacting with the external surface of the protective cover, the belting film may receive heat from the heated protective cover. Also, the protective cover may prevent the heating element from being damaged due to the quickly rotating film.

In this instance, the heating element may be a heating element such as a halogen lamp. Also, the heating element may directly contact with the fixing roller or be provided adjacent to the fixing roller and thereby effectively transmit heat. Also, the heating element may be in a static state, that is, in a motionless state. However, the present general inventive concept is not limited thereto, and thus the heater may be in a dynamic state, that is, in a moving or rotating state with respect to the fixing roller.

The foregoing and/or other aspects and utilities of the present general inventive concept may also be achieved by providing an image heating apparatus including: a pressure roller; a fixing roller to rotate in engagement with the pressure roller; a heater to be provided adjacent to an external surface of the fixing roller, comprise an internal surface which is concavely formed corresponding to the external surface of the fixing roller, and thereby directly heat the external surface of the heating roller; and a belting film to circulate around the fixing roller, form a nip with the pressure roller, and pass through a gap between the pressure roller and the fixing roller while contacting with an external surface of the heater.

The heater may include a concavely formed internal surface in correspondence to the external surface of the fixing roller, to transmit heat to the fixing roller. Also, a distance between the internal surface of the heater and the external surface of the fixing roller may be maintained at a minimum level and a facing surface area may be maintained at a maximum level. Also, the heater may include an external surface capable of transmitting heat to the belting film. In this instance, since the belting film passes through the gap between the pressure roller and the fixing roller while contacting with the external surface of the heater, the heat may be effectively transmitted from the belting film.

The foregoing and/or other aspects and utilities of the present general inventive concept may also be achieved by providing an image heating apparatus including a fixing roller to fix a toner image to a recording medium, a film to enclose the fixing roller to contact an outer surface of the fixing roller with an inner surface of the film and to contact the recording medium including the toner image, and a heater disposed within the film such that the film rotates around both the fixing roller and the heater and heats both an external surface of the fixing roller and the film simultaneously.

The heater may include a heating element and a protective cover surrounding the heating element on three sides such that the protective cover has an opening facing the fixing roller to radiate heat thereto while at least one of the three remaining sides contacts the film to transfer heat thereto.

The heating element may include a heating member including a first surface facing the fixing roller to radiate heat thereto, and at least one other surface in contact with the film to transfer heat thereto.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
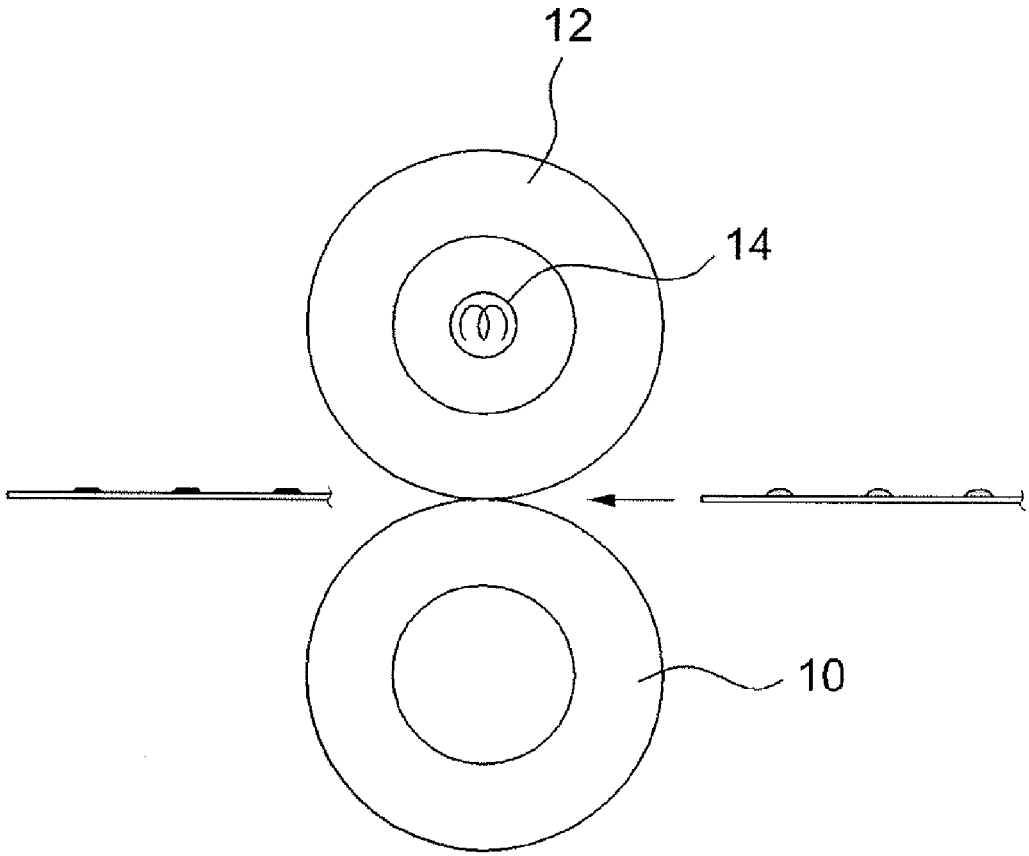
FIG. 1 (CONVENTIONAL ART)
FIG. 1 is a cross-sectional view illustrating an image heating apparatus according to a conventional art.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
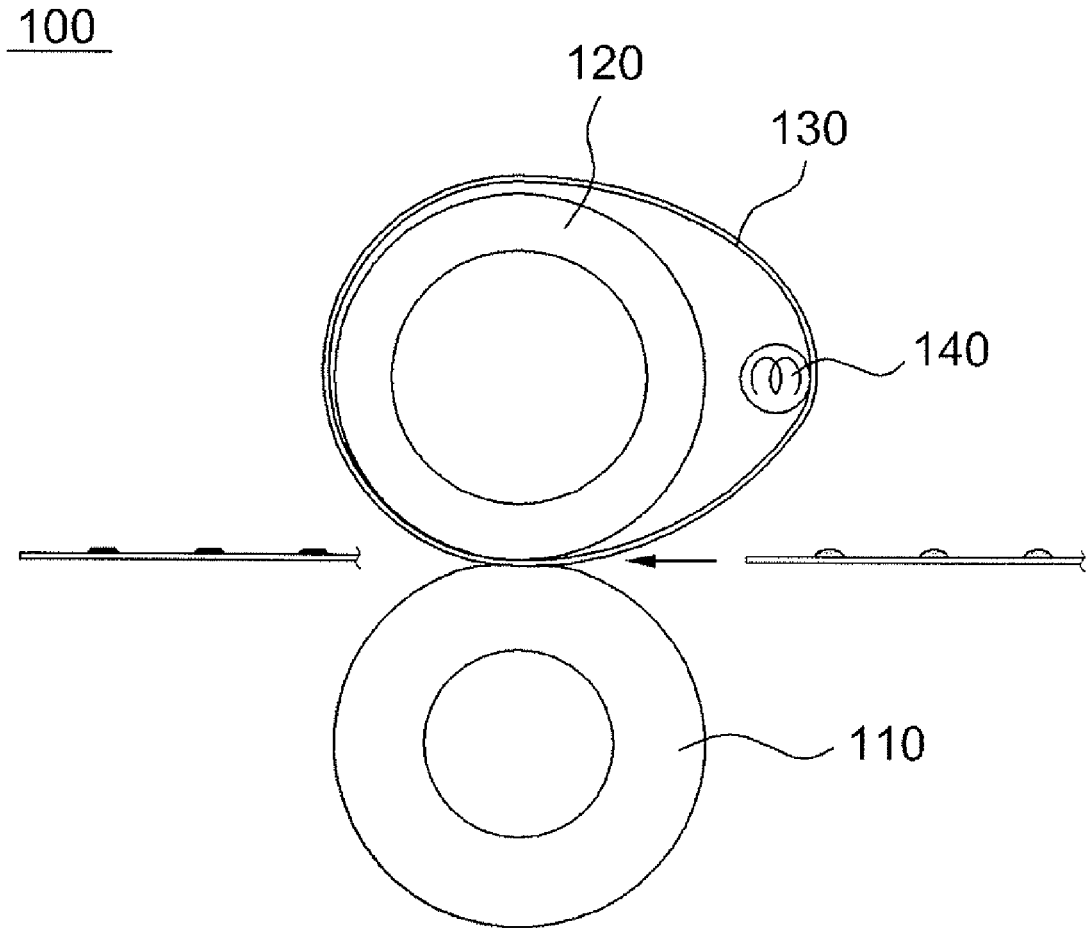
FIG. 3 is a cross-sectional view illustrating an image heating apparatus according to an embodiment of the present general inventive concept.

FIG. 3 is a cross-sectional view illustrating an image heating apparatus 100 according to an embodiment of the present general inventive concept.

Referring to FIG. 3, the image heating apparatus 100 includes a pressure roller 110, a fixing roller 120, a belting film 130, and a heater 140. The pressure roller 110 is provided below the fixing roller 120, and forms a nip with the pressure roller 110 by using the belting film 130 as a medium for mutual engagement. The heater 140 is provided adjacent to the fixing roller 120, and is also provided adjacent to an inlet of the nip around the fixing roller 120. Accordingly, the belting film 130 is heated by the heater 140 before passing through the nip. Also, the heater 140 may continuously heat an external surface of the fixing roller 120.

The external surface of the pressure roller 110 and the fixing roller 120 may be formed using a rubber material, and thus the pressure roller 110 and the fixing roller 120 may rotate in engagement with each other in a pressurized state. In the present embodiment, the pressure roller 110 and the fixing roller 120 exclude a lamp heating element or a conductive heating element. However, the present general inventive concept is not limited thereto, and thus the pressure roller 110 and the fixing roller 120 may have a heating element embedded therein to raise a warm-up temperature or maintain the heating temperature.

Also, the heater 140 may be formed using a heating element with a heating function capable of uniformly maintaining the heating temperature. In this instance, the heater 140 may have a structure, such as a halogen lamp and a ceramic heating element, to simultaneously heat at least two surfaces, such as surfaces of both the fixing roller 120 and the belting film 130.

The heater 140 should heat both the fixing roller 120 and the belting film 130. Accordingly, the heater 140 may be provided between the fixing roller 120 and the belting film 130. In this instance, the heater 140 may contact with the fixing roller 120 or the belting film 130 or maintain only a close distance therefrom. Accordingly, the heater 140 may directly heat the fixing roller 120 without a medium by using a heat conduction or a heat radiation. In this instance, the initial warm-up in the nip is progressed by heating of the belting film 130, and thus it may be desirable that the belting film 130 directly transmits heat through the heat conduction while directly contacting with the external surface of the heater 140.

Figure 2:
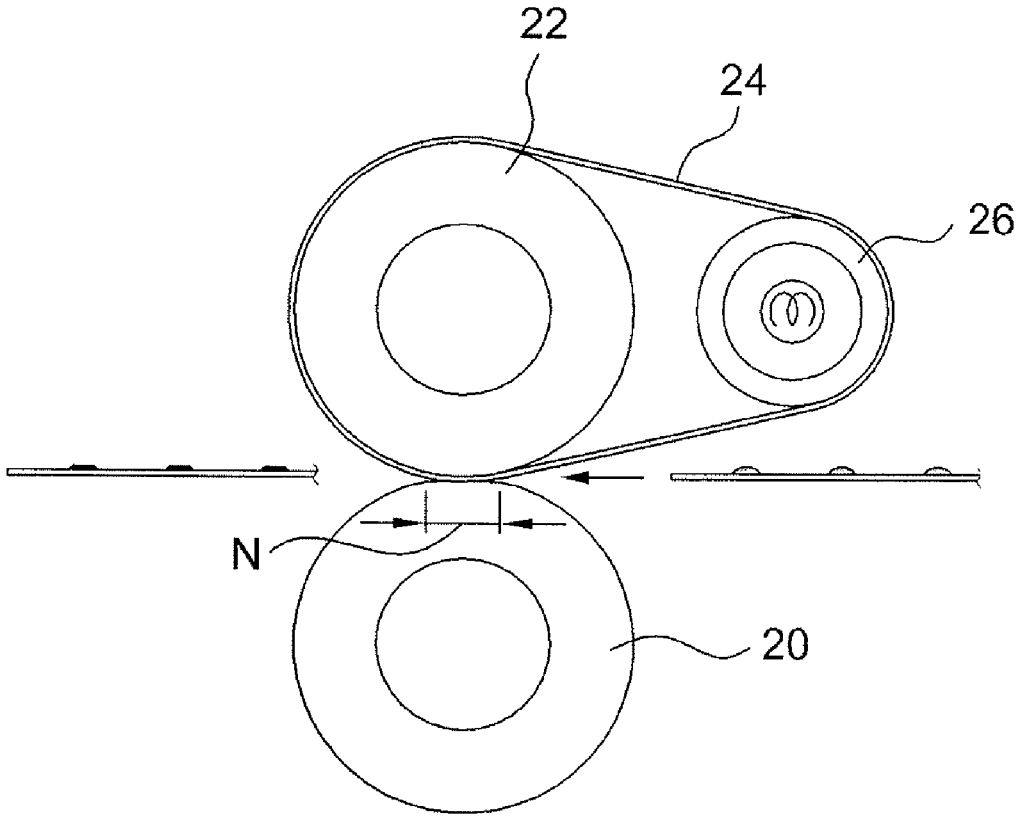
FIG. 2 (CONVENTIONAL ART)
FIG. 2 is a cross-sectional view illustrating another image heating apparatus according to the conventional art.

Also, a relative slip may occur between the circulating belting film 130 and the heater 140. Specifically, the heater 140 may maintain a static state without rotation and the belting film 130 may pass through the gap between the pressure roller 110 and the fixing roller 120, and thereby the relative slip may occur between the belting film 130 and the heater 140. Particularly, the heater 140 does not utilize a heating roller surrounded by a rubber material, which is different from the conventional image heating apparatus of FIG. 2. Accordingly, the heater 140 may directly heat the external surface of the fixing roller 120 through a heat radiation and the like.

According to the present embodiment, the belting film 130 has a comparatively smaller heat capacity and thus may be quickly heated. Accordingly, the initial warm-up may be quickly completed by the belting film 130. Conversely, the fixing roller 120 has a comparatively greater heat capacity and thus may not be quickly heated. However, once the fixing roller 120 is heated up to a desirable temperature, the fixing roller 120 functions as a heat reservoir. Accordingly, the fixing roller 120 may help the heating temperature to be uniformly maintained. Also, a process of heating the belting film 130 and a process of heating the external surface of the fixing roller 120 may be simultaneously performed. Both of the processes may be simultaneously performed while the heating is ongoing.

Figure 4:
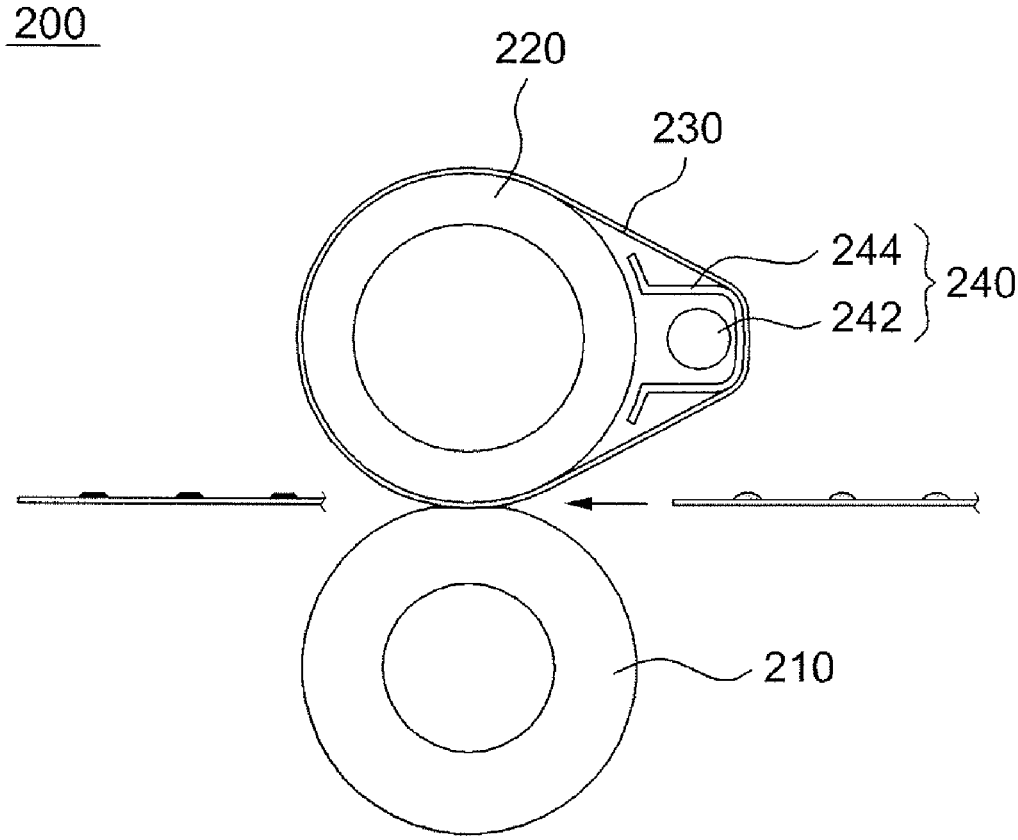
FIG. 4 is a cross-sectional view illustrating an image heating apparatus according to another embodiment of the present general inventive concept.

FIG. 4 is a cross-sectional view illustrating an image heating apparatus 200 according to another embodiment of the present general inventive concept.

Referring to FIG. 4, the image heating apparatus 200 includes a pressure roller 210, a fixing roller 220, a belting film 230, and a heater 240. The pressure roller 210 is provided below the fixing roller 220, and forms a nip with the fixing roller 220 by using the belting film 230 as a medium for mutual engagement. The heater 240 is provided adjacent to the fixing roller 220, and is also provided adjacent to an inlet of the nip around the fixing roller 220. Also, the heater 240 includes a heating element 242 and a protective cover 244, and may heat each of the fixing roller 220 and the belting film 230. Accordingly, the belting film 230 is heated by the protective cover 244, which is heated by the heating element 242, before passing through the nip. Also, the heater 240 may continuously heat an external surface of the fixing roller 220.

The external surface of the pressure roller 210 and the fixing roller 220 may be formed using a rubber material, and thus the pressure roller 210 and the fixing roller 220 may rotate in engagement with each other in a pressurized state. In the present embodiment, the pressure roller 210 and the fixing roller 220 exclude a lamp heating element or a conductive heating element. However, the present general inventive concept is not limited thereto, and thus the pressure roller 210 and the fixing roller 220 may have a heating element embedded therein to raise a warm-up temperature or maintain the heating temperature.

As described above, the heater 240 includes the heating element 242 and the protective cover 244. Also, the heating element 242 may be formed using a heating element with a heating function capable of uniformly maintaining the heating temperature. As an example, a heating lamp, such as a halogen lamp, may be used for the heating element 242. Also, the protective cover 244 contains the heating element 242, and has an open side facing towards the fixing roller 220. Accordingly, although the heating element 242 is contained in the protective cover 244, the heating element 242 may directly heat the external surface of the fixing roller 220. Also, the protective cover 244 may transmit heat generated from the heating element 242 to the belting film 230, and thus may be formed using a heat conductive material, for example, a metal material such as stainless steel.

The protective cover 244 covers around the heating element 242, so that the atmosphere heated from the heating element 242 may remain around the heating element 242 and the heating element 242 may intensively heat the external surface of the fixing roller 220. Also, the protective cover 244 may protect the heating element 242 from being damaged due to the quickly rotating belting film 230.

Since the heater 240 should heat both the fixing roller 220 and the belting film 230, the heater 240 is provided between the fixing roller 220 and the belting film 230. In this instance, the heating element 242 may contact with the fixing roller 220 or maintain only a close distance therefrom. Also, the protective cover 244 may supply heat to the belting film 130 through a heat conduction while contacting with the belting film 230.

Also, the circulating belting film 230 may transmit heat while passing by the external surface of the protective cover 244. The heating element 242 and the protective cover 244 of the heater 240 may maintain the static state without rotation. When the belting film 230 passes through the gap between the pressure roller 210 and the fixing roller 220 while contacting with the external surface of the protective cover 244, the relative slip may occur between the belting film 230 and the external surface of the protective cover 244.

According to the present embodiment, the belting film 230 has a comparatively smaller heat capacity and thus may be quickly heated. Accordingly, the initial warm-up may be quickly completed by the belting film 230. Conversely, the fixing roller 220 has a comparatively greater heat capacity and thus may not be quickly heated. However, once the fixing roller 220 is heated up to a desirable temperature, the fixing roller 220 functions as a heat reservoir. Accordingly, the fixing roller 220 may help the heating temperature to be uniformly maintained. Also, a process of heating the belting film 230 and a process of heating the external surface of the fixing roller 220 may be simultaneously performed. Both of the processes may be simultaneously performed while the heating is ongoing.

When a lamp with a capacity of about 850 W is utilized in the image heating apparatus of FIG. 4, it may generally take about 8 to 10 seconds to raise the image heating apparatus from room temperature up to about 160° C. When considering that the conventional image heating apparatus of FIG. 2 needs an initial warm-up time of about 20 to 22 seconds, the image heating apparatus of the present general inventive concept is very effective.

Figure 5:
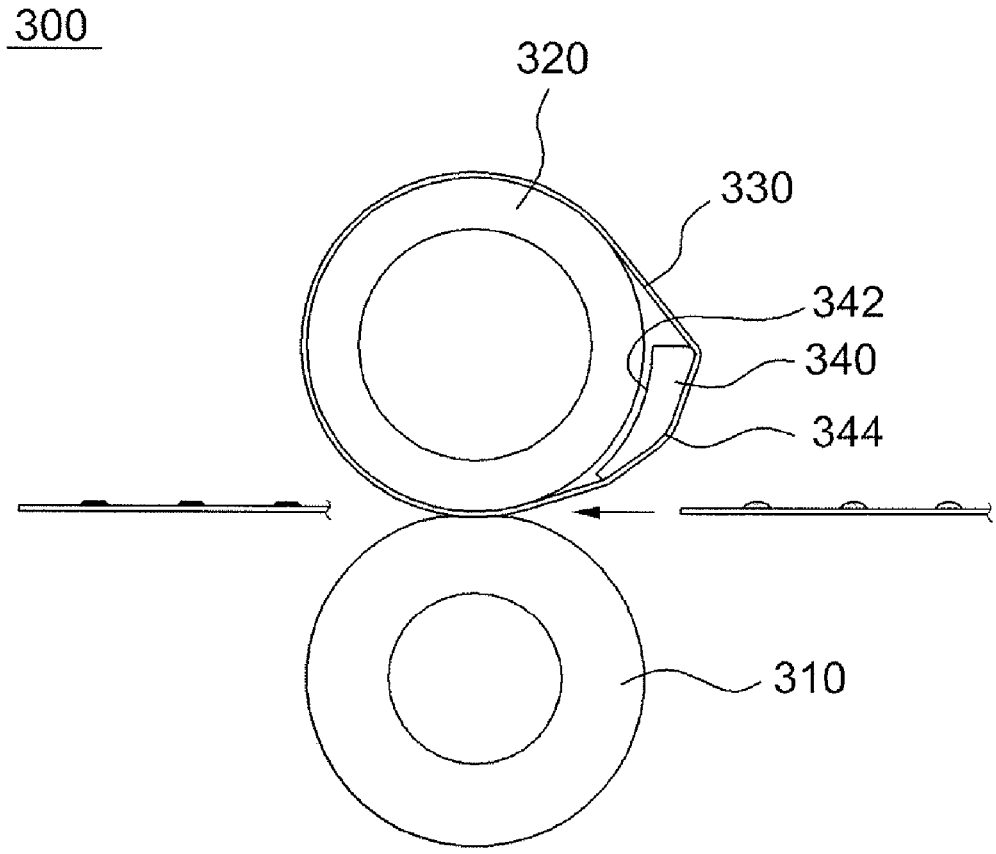
FIG. 5 is a cross-sectional view illustrating an image heating apparatus according to still another embodiment of the present general inventive concept.

FIG. 5 is a cross-sectional view illustrating an image heating apparatus 300 according to still another embodiment of the present general inventive concept.

Referring to FIG. 5, the image heating apparatus 100 includes a pressure roller 310, a fixing roller 320, a belting film 330, and a heater 340. The pressure roller 310 is provided below the fixing roller 320, and forms a nip with the pressure roller 310 by using the belting film 330 as a medium for mutual engagement. The heater 340 is provided adjacent to the fixing roller 320, and is also provided adjacent to an inlet of the nip around the fixing roller 320. Also, the heater 340 may include a concavely formed internal surface 342 to face the fixing roller 220, and an external surface 344 to correspond to the internal surface 342. The heater 340 may heat each of the fixing roller 320 and the belting film 330. Accordingly, the belting film 330 is heated by the external surface 344 of the heater 340 before passing through the nip. Also, the heater 340 may continuously heat an external surface of the fixing roller 320.

The external surface of the pressure roller 310 and the fixing roller 320 may be formed using a rubber material and thus the pressure roller 310 and the fixing roller 320 may rotate in engagement with each other in a pressurized state. In the present embodiment, the pressure roller 310 and the fixing roller 320 exclude a lamp heating element or a conductive heating element. However, the present general inventive concept is not limited thereto, and thus the pressure roller 310 and the fixing roller 320 may have a heating element embedded to raise a warm-up temperature or maintain the heating temperature.

As described above, the heater 340 includes the concavely formed internal surface 342 and the relatively protruding external surface 344. Also, the heater 340 may be formed using a heating element with a heating function capable of uniformly maintaining the heating temperature. As an example, a ceramic heating element may be utilized to heat element.

The heater 340 includes the internal surface 342 concavely formed in correspondence to the external surface of the fixing roller 320 to transmit heat. Also, a distance between the internal surface 342 of the heater 340 and the external surface of the fixing roller 320 is maintained at a minimum level. In this instance, it is possible to readily transmit heat to the fixing roller 320 by optimally forming the internal surface 342 and external surface 344 of the heater 340. Also, the heater 340 may include the protruding external surface 344 capable of transmitting heat to the belting film 330. Also, since the belting film 330 passes while contacting with the external surface 344 of the heater 340, heat may be effectively transmitted to the belting film 330. The protruded external surface 344 of the heater 340 may be variously formed. Also, a bottom portion of the external surface 344 of the heater 340 may be variously formed. Through the various adjustments, the shape and length of the nip may be variously adjusted.

The heater 340 should heat both the fixing roller 320 and the belting film 330. Accordingly, the heater 340 may be provided between the fixing roller 320 and the belting film 330. In this instance, the internal surface 342 of the heater 340 may contact with the fixing roller 320 or maintain only a close distance therefrom. Also, the external surface 344 of the heater 340 may transmit heat to the belting film 330 through the heat conduction while contacting with the belting film 330.

Also, heat may be transmitted to the circulating belting film 330 while passing the external surface of the heater 340. In this instance, the heater 340 may maintain the static state without rotation. When the belting film 330 passes through the gap between the pressure roller 310 and the fixing roller 320 while contacting with the external surface of the heater 340, a relative slip may occur between the belting film 330 and the external surface of the heater 340.

According to the present embodiment, the belting film 330 has a comparatively smaller heat capacity and thus may be quickly heated. Accordingly, the initial warm-up may be quickly completed by the belting film 330. Conversely, the fixing roller 320 has a comparatively greater heat capacity and thus may not be quickly heated. However, once the fixing roller 320 is heated up to a desirable temperature, the fixing roller 320 functions as a heat reservoir. Accordingly, the fixing roller 320 may help the heating temperature to be uniformly maintained. Also, a process of heating the film and a process of heating the external surface of the fixing roller 320 may be simultaneously performed. The both processes may be simultaneously performed while the heating is ongoing.

The image heating apparatus according to the various embodiments may uniformly maintain a heating temperature in a nip, and provide a quick warm-up time. According to test results, when a lamp with a capacity of about 850 W was used, it generally took about 8 to 10 seconds to raise the image heating apparatus from room temperature up to about 160° C. Specifically, even when using a heater with a comparatively smaller capacity than the conventional image heating apparatus, an initial warm-up time may be reduced to almost half of an initial warm-up time of the conventional image heating apparatus.

Also, when a protective cover protects a heating element of a heater, the protective cover may cover around the heating element, so that the atmosphere heated from the heating element may remain around the heating element and the heating element may intensively heat the external surface of a fixing roller. Also, the protective cover may protect the heating element from being damaged due to the quickly rotating belting film.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image heating apparatus comprising:

a pressure roller;

a fixing roller to rotate in engagement with the pressure roller;

a heater including a protective cover which is provided adjacent to an external surface of the fixing roller and is open towards the fixing roller, and a heating element which is contained in the protective cover and directly heats the external surface of the fixing roller; and a belting film to circulate around the fixing roller, form a nip with the pressure roller, and pass through a gap between the pressure roller and the fixing roller while contacting with an external surface of the protective cover.

2. The apparatus of claim 1, wherein the heating element is provided to either contact with the external surface of the fixing roller or be adjacent to the external surface of the fixing roller.

3. The apparatus of claim 1, wherein the heating element is in a static state.

4. The apparatus of claim 1, wherein the heating element is a heating lamp.

5. An image heating apparatus comprising:

a pressure roller;

a fixing roller to rotate in engagement with the pressure roller;

a heater provided adjacent to an external surface of the fixing roller, including an internal surface concavely formed corresponding to the external surface of the fixing roller, and to directly heat the external surface of the fixing roller; and a belting film to circulate around the fixing roller, form a nip with the pressure roller, and pass through a gap between the pressure roller and the fixing roller while contacting with an external surface of the heater.

6. The apparatus of claim 5, wherein the internal surface of the heater heats the external surface of the fixing roller through a heat conduction or a heat radiation.

7. The apparatus of claim 5, wherein the heater is a ceramic heating element.

* * * * *